United States Patent [19]

Zoni

[11] Patent Number: 4,993,107

[45] Date of Patent: Feb. 19, 1991

[54] FILTERING AND COLLECTING DEVICE OF SOLID AND POWDER REFUSE FOR INDUSTRIAL AND CIVIL SUCTION APPARATUS

[75] Inventor: Sergio Zoni, Parma, Italy

[73] Assignee: Dulevo S.p.A., Sanguinaro di Fontanellato, Italy

[21] Appl. No.: 351,520

[22] Filed: May 15, 1989

[30] Foreign Application Priority Data

May 20, 1988 [IT] Italy ..... 20603 A/88

[51] Int. Cl.[5] ..... A47L 5/28

[52] U.S. Cl. ..... 15/352; 15/347; 15/353; 55/294; 55/429; 55/471; 55/DIG. 3

[58] Field of Search ..... 15/347, 352, 353; 55/295, 296, 429, 471, DIG. 3, 94

[56] References Cited

U.S. PATENT DOCUMENTS

| | | | |
|---|---|---|---|
| 1,864,782 | 6/1932 | White | 55/295 X |
| 3,208,202 | 9/1965 | Herubel | 55/429 X |
| 3,484,889 | 12/1969 | McCandless | 15/340 |
| 3,624,989 | 12/1971 | Gatheridge | 15/347 X |
| 3,797,064 | 3/1974 | MacFarland | 15/351 |
| 3,813,725 | 6/1974 | Rinker | 15/347 |
| 3,910,781 | 10/1975 | Bryant | 15/347 X |
| 4,535,501 | 8/1985 | Hollowell et al. | 15/339 |
| 4,567,623 | 2/1986 | Walton | 15/337 |
| 4,713,858 | 12/1987 | Kelber | 15/347 |
| 4,921,510 | 5/1990 | Plooy | 15/352 |

FOREIGN PATENT DOCUMENTS

| | | |
|---|---|---|
| 0121511 | 3/1984 | European Pat. Off. . |
| 608538 | 6/1976 | Fed. Rep. of Germany . |
| 974353 | 6/1960 | United Kingdom . |

OTHER PUBLICATIONS

"Dust Collectors", Nov.-Dec. 1987, *Fine Woodworking* Magazine, p. 71.

*Primary Examiner*—Chris K. Moore
*Attorney, Agent, or Firm*—Browdy and Neimark

[57] ABSTRACT

The invention relates to a filtering and collecting device of solid and powder refuse for industrial and civil suction apparatus equipped with at least one flexible, removable storage bag (17) and means (4) of drawing in and conveying refuse to the storage bag (17) adapted to form a flow of air and refuse, the device comprising: an air and refuse sorting zone (16*a*) supplied with the flow of air and refuse, at least one filter (19) communicated with the sorting zone (16*a*) and adapted to allow for the escape of air from the flow, and the storage bag (17) communicated with the sorting zone (16*a*) and made of an impervious material of the disposable type, to be thrown away together with refuse collected therein.

10 Claims, 1 Drawing Sheet

Figure 1:
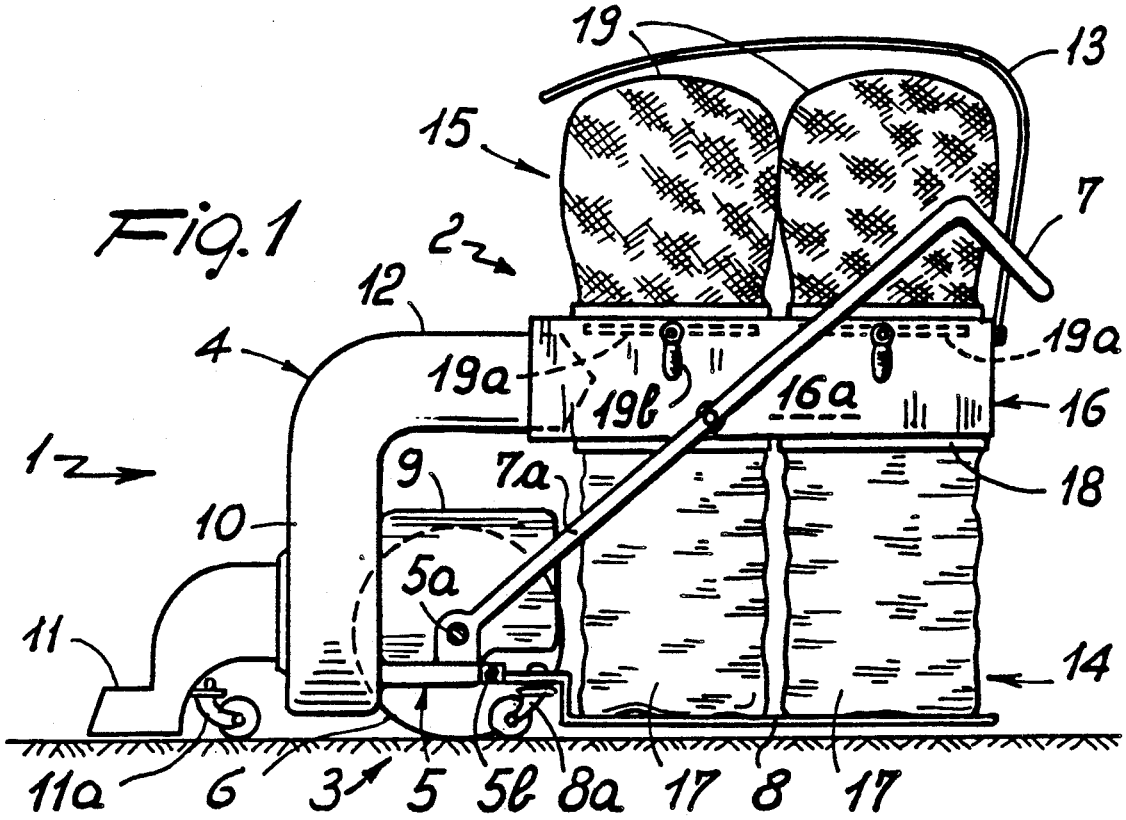

19
13
15
7
2
12
4
19a
19b
16a
16
19a
1
9
7a
18
10
5a
11
14
11a
6
3
5
5b
8a
17
8
17

22
13
19
21
15
20
7
2
12
20a
16a
16
4
18
1
9
7a
10
23
5a
14
11
11a
6
3
5
5b
8
8a
17

FILTERING AND COLLECTING DEVICE OF SOLID AND POWDER REFUSE FOR INDUSTRIAL AND CIVIL SUCTION APPARATUS

This invention relates to a filtering and collecting device of solid and powder refuse for industrial and civil suction apparatus, and specifically for suction apparatus or equipment incorporating a refuse storage means which comprises at least one flexible and removable bag.

It is recognized that suction equipment or apparatus both require that the suction air be filtered and let through and that the powder and solid refuse picked up be stored up therein.

Many suction apparatus used on certain industrial and civil areas have the beneficial characteristic of employing a filtering and collecting means which conveys the air, powder, and solid refuse drawn in directly into at least one filtering storage bag which is flexible and detachable. With this engineering approach, emptying, cleaning, and maintaining such suction apparatus can be made simpler and quicker.

To permit of the air conveyed along with dust and solid refuse transpiration, the storage bag of such devices is in the form of bags or pouches made, for instance, of a porous paper or a fabric having a suitable porosity. Plastics bags would serve no purpose because, owing to their being impervious, they cannot let air therethrough.

Said bags or pouches are of two types: a permanent type, which is saved and emptied after a number of cycles to also re-establish optimum filtering conditions; or a disposable type, to be thrown away when filled and replaced with new bags. Re-usable bags must be made of some strong material, usually of fabric, whereas disposable bags are made of paper or the like low-cost material.

Such suction apparatus with at least one flexible, removable storage and filtering bag show serious deficiencies when subjected to severe working conditions in industrial applications or city or civil area cleaning applications.

In fact, with filtering bags of the disposable type it is generally difficult to work outdoors on broad surfaces, especially when wet, because filters made of paper or the like materials are torn and disintegrated once wet by the impact from solid refuse.

Where fabric bags are used, on the other hand, it is the emptying and recovering operation that becomes difficult as well as being unsanitary, because this operation can raise a lot of dust sweeping over the operator. In addition, one often has no idea of where to go for emptying them, or the dumping site is relatively far away and involves significant downtime for transportation. Of course, fabric bags cannot be thrown away on account of their high cost.

In actual practice, despite the advantages from simplicity and practicality afforded by the conveyance of air, dust, and solid refuse into one or more filtering and storage bags, the cited drawbacks are so serious that the use of said suction apparatus only becomes possible on certain areas, or where the amounts of dust and refuse to be removed are minimal.

Thus, the technical problem remains unsolved of how to provide a filtering and collecting device, of the type based upon the conveyance of the refuse to at least one flexible, removable storage bag, which can be effectively utilized under a variety of environmental conditions and on broad industrial or civil areas. This being the situation, the technical aim of this invention is to provide a device which can solve said technical problem and substantially obviate the cited drawbacks. Within the scope of this technical aim, an important object of the invention is to provide a low-cost device with a simple structure, which can gain widespread acceptance and utilization.

The above-mentioned aim, and specific object, are substantially achieved by a filtering and collecting device of solid and powder refuse for industrial and civil suction apparatus, comprising at least one flexible, removable storage bag, and a suction and conveyance means for conveying said refuse to at least one said storage bag and adapted to form a flow of air and refuse, said filtering and collecting device being characterized in that it comprises:

a sorting zone for said air and said refuse supplied with said flow of air and refuse;

at least one filter placed in communication with said sorting zone and adapted to allow air from said flow to escape; and at least one said storage bag placed in communication with said sorting zone and made of a substantially impervious material and of the disposable type, to be thrown away together with the refuse matter collected therein.

Figure 2:
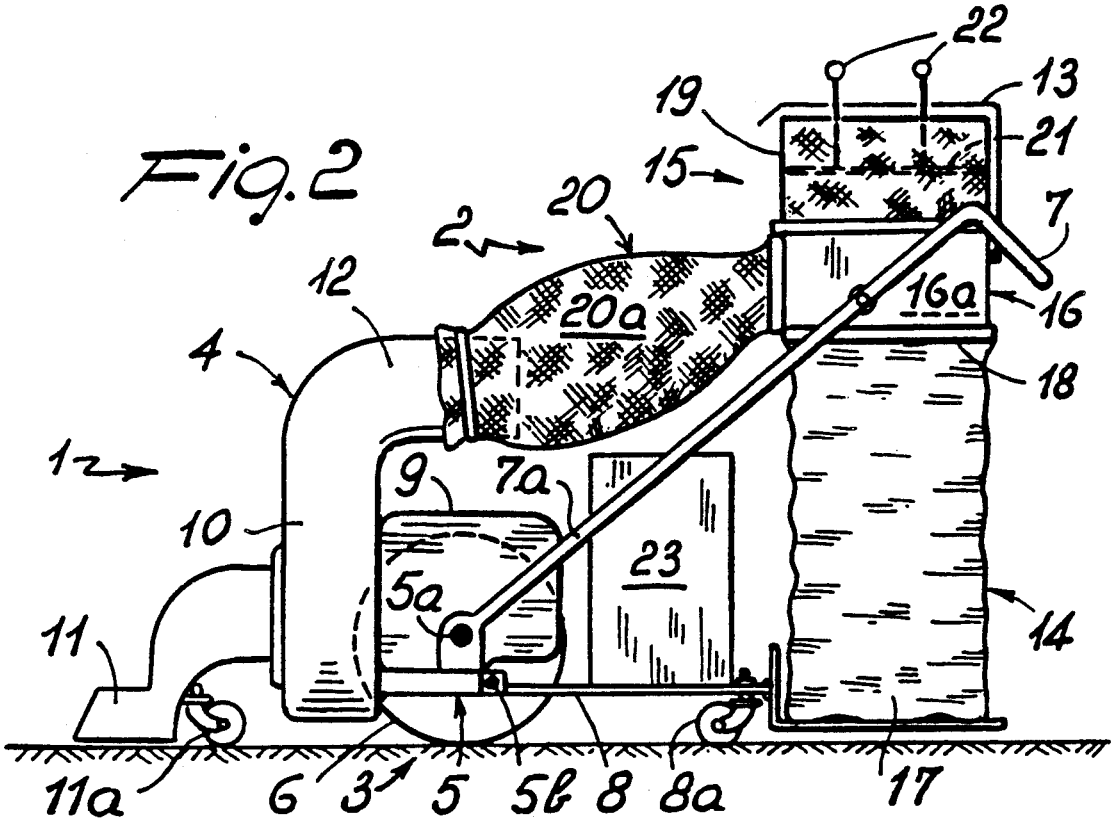

Further features will become apparent from a detailed description of two preferred embodiments of a device according to the invention, shown in the accompanying drawings, where:

FIG. 1 shows a suction apparatus incorporating a device according to the invention which has two refuse storage bags with fabric filter bags; and FIG. 2 shows a suction apparatus similar to the one shown in FIG. 1 but incorporating a device having a single storage bag with a cartridge-type filter.

With reference to all of the drawing views, the device of this invention is shown to be inserted in a suction apparatus or machine 1 as used to clean large municipal areas, perhaps directly by personnel of the municipal street cleansing service.

The suction apparatus 1 is mainly comprised, additionally to the inventive device indicated at 2, of a supporting and guiding structure 3, and refuse suction and conveyance means 4.

The structure 3 comprises a support 5, two wheels 6, handlebars 7, and a truck portion 8. The support 5 carries the wheels 6 rotatably by means of an axle 5*a*, and the truck portion oscillutably which is provided with at least one caster 8*a*, by means of a swivel joint 5*b*. The handlebars 7 comprise two bars 7*a* which extend laterally of the suction apparatus 1, from the support 5 to man's height. The suction and conveyance means 4 comprise a motor 9 mounted fixedly on the support 5 and a fan 10 driven by the motor 9.

The suction side of the fan 10 is connected to a suction port 11 provided with a caster 11*a*, and the fan delivery side is connected to a conveyance duct 12. The suction and conveyance means 4 form in combination a flow of air and solid and powder refuse which extends from the suction port 11 to beyond the conveyance duct 12.

The device 2 according to the invention is locates downstream from the suction and conveyance means 4 in the flow direction of the air and refuse stream, and is engaged by the side bars 7*a* of the handlebars 7. In addition, it is overlaid by a case 13 which is manually controlled to tilt or detach.

According to the invention, the device 2 comprises refuse collecting or storage member$ 14, filtering members 15, and a manifold 16 positioned at said members 14 and 15 and defining a sorting zone 16*a* therebetween.

With reference to FIG. 1, the collecting members 14 comprise two storage bags 17 in the forms of collecting bags to be thrown away with the refuse, being of a standard impervious plastics type for municipal street cleansing and refuse collection. The storage bags 17 are supported at the bottom on the truck portion 8 of the support 5.

The manifold 16, which is rigid and engaged with the side bars 7*a* of the handlebars 7, comprises at the bottom two ports 18 for removable attachment to said storage bags.

The manifold 16 has mounts instead at the top, for the filtering members 15 in the forms of one or more filters 19. In FIG. 1, the filters 19 are formed of two flexible filter bags vertically overlying the storage bags 17.

Between the filters 19 and the storage bags 17 there may be advantageously provided, as shown in FIG. 1, foraminous partition septa 19*a*, e.g. of wire mesh or perforated sheet metal, which are engaged with levers 19*b* or the like operable from outside the suction apparatus 1 to shake said foraminous partition septa 19*a*.

FIG. 2 shows a suction apparatus 1 which differs from that shown in FIG. 1 substantially by having a single filter 19 of the cartridge type, made of a special paper and substantially rigid, overlying a single storage bag 17.

Further in FIG. 2, there is advantageously provided a means 20 of controlling the strength of the air flow from the fan 10, provided on a conveyance body 20*a* placed between the manifold 16 and the suction and conveyance means 4. The control means 20 on the conveyance body 20*a* is formed by portions of a filtering material of the conveyance body 20*a* itself, such as of a porous cloth. In the example shown, the conveyance body 20*a* is made of cloth throughout.

Shown in FIG. 2 are cleaning members for cleaning the interior of the cartridge filter 19, which are embodied by a brush element 21 adapted to be reciprocated manually from the above downwards by means of the knobs 22 which are passed through the filters 19.

In FIG. 2 there is also shown a rigid emergency basket 23 placed on the truck 8.

The device 2 operates as follows.

With the motor 9 and fan 10 in operation, the suction port 11 will pick up anything within its reach lying on the ground, as the operator moves forward with the suction apparatus or machine 1, by pushing it through the handlebars 7.

The air drawn in together with dust and small lightweight solid bits, such as pieces of paper, will be forced, through the conveyance duct 12, into the manifold 16 and out through the filters 19 which hold back the dust and lightweight solid bits, whereas the heaviest ones will fall directly into the underlying storage bags 17. If the foraminous partition septa 19*a* are provided, in the filters 19 dust will collect only.

At the end of the job, or when the storage bags 17 have been filled, the operator will stop the motor 9 and fan 10, thereby the contents of the filters 19 tends to fall naturally into the underlying storage bags 17 because of the interrupted air flow.

In any case, the operator can act on the filters 19 so as to drop their contents into the underlying storage bags, for example, by shaking the filter bags with his hands, or where a cartridge filter is used, by operating the brush elements 21 through the knobs 22. In operation of the machine, the brush elements 21 would be held in a raised position not to hinder the flow of air.

The foraminous partition septa 19*a* may also be shaken by means of the levers 19*b*.

The operator will then remove the storage bags 17 from the manifold 16, tie them closed, and throw them away together with the refuse collected on their inside. The operator can then return the suction apparatus 1 to its operative condition by applyng new storage bags 17 to it.

The guard case 13 prevents dust from sweeping over the operator, even in the unlikely event of the filters 19 being ruptured.

The air flow control means 20 provided on the conveyance body 20*a* attenuate the strength of the air flow, permitting enhanced escape of the same and, therefore, high power motor 9 and fan 10 to be used. Because of the conveyance body 20*a* being provided directly ahead of the manifold 16, it will not affect the suction capacity of the device: solid and powder refuse will have acquired by now a sufficient velocity to reach the manifold 16.

The invention achieves important advantages.

In fact, the invention enables simple and inexpensive storage bags (17) to be used which are made of plastics or some other disposable material for refuse collection, while the filtering action takes place on filters (19) of a suitable material, which do not require replacement except on the occurrence of fortuitous ruptures or of wear over time.

The attachment ports (18) for the storage bags (17) may be adjusted to fit the bags normally used by the refuse collection services of various towns, and are therefore readily available. These bags can also receive solid objects and refuse picked up from wet surfaces. It is obvious that said plastics bags may also be guarded externally or temporarily inserted, during the picking-up operation, into a bag of a strong fabric to prevent their rupture for unforeseen reasons during the picking-up operation and the collected material from spreading over the ground.

The mutual positions of the storage bags (17) and filters (19) enable natural sorting of the air and dust, on the one side, and solid refuse, on the other side, during the job, and an immediate conveying into the storage bags (17) of the dust as well on completion of the job.

The position of the filtering and collecting device according to the invention at the end of the flow of air and solid and powdery refuse, downstream from the fan 10 which generates the flow, enables the fan 10 to be located closest to the suction port 11 to provide a strong suction effect and reliable removal of the refuse from the ground.

Furthermore, said position enables the provision of said means (20) of controlling the oncoming air flow to the sorting zone (16*a*).

In fact, this control means (20) only controls the strength of the flow at the filtering and collecting device according to the invention and does not affect the suction action of the fan 10 at the port 11. It thus becomes possible to provide fans 10 and motors 9 even of high power.

I claim:

1. In a filtering and collecting device of solid and powder refuse for industrial and civil suction apparatus, including at least one flexible, removable storage bag (17) and a suction and conveyance means (4) for conveying the refuse to at least one said storage bag (17) and adapted to form a flow of air and refuse, the improvement comprising:

a wall defining a sorting zone (16*a*) for the air and the refuse supplied with the flow of air and refuse;

at least one substantially rigid filter (19) of the cartridge type placed in communication with said sorting zone (16*a*) and adapted to allow air from said flow to escape; and at least one said storage bag (17) placed in communication with said sorting zone (16*a*) and made of substantially impervious material and of the disposable type, to be thrown away together with the refuse matter collected therein, wherein cleaning members are provided for said at least one filter (19) of the cartridge type which comprise at least one brush element (21) inserted into said at least one filter (19) and at least one knob (22) engaged with said brush element (21) and passed through said filter (19).

2. A device according to claim 1, wherein said wall defining said sorting zone (16*a*) comprises a substantially rigid manifold (16), said manifold (16) separating at least one said storage bag (17) from at least one said filter (19).

3. A device according to claim 2, wherein at least one said storage bag (17) is a plastics collecting bag of the type used by municipal refuse collecting services, to be thrown away with the collected refuse, and wherein said manifold (16) comprises at least one attachment port (18) sized to fit said plastics collecting bag for municipal refuse collection.

4. A device according to claim 1, wherein at least one said filter (19) and at least one said storage bag (17) are substantially aligned vertically to each other.

5. A device according to claim 1, wherein said sorting zone (16*a*) is located downstream from said suction and conveyance means (4) relative to the direction of flow of the air and refuse.

6. In a filtering and collecting device of solid and powder refuse for industrial and civil suction apparatus, including at least one flexible, removable storage bag (17) and a suction and conveyance means (4) for conveying the refuse to at least one said storage bag (17) and adapted to form a flow of air and refuse, the improvement comprising:

a wall defining a sorting zone (16*a*) for the air and the refuse supplied with the flow of air and refuse, said sorting zone (16*a*) being located downstream from said suction and conveyance means (4) relative to the direction of flow of the air and refuse;

at least one filter (19) placed in communication with said sorting zone (16*a*) and adapted to allow air from said flow to escape; and at least one said storage bag (17) placed in communication with said sorting zone (16*a*) and made of substantially impervious material and of the disposable type, to be thrown away together with the refuse matter collected therein, wherein a means (20) is provided for controlling the strength of the oncoming air flow to said sorting zone (16*a*), said means being adapted to provide for the escape of air ahead of one said filter (19).

7. A device according to claim 6, wherein said means for controlling the strength of the incoming air between said sorting zone (16*a*) and said suction and conveyance means (4) comprises a conveyance body (20*a*) for said flow.

8. A device according to claim 7, wherein said control means (20) is at least one filtering cloth portion of said conveyance body (20*a*).

9. A device according to claim 6, wherein said wall defining said sorting zone (16*a*) comprises a substantially rigid manifold (16), said manifold (16) separating at least one said storage bag (17) from at least one said filter (19).

10. A device according to claim 5, wherein at least one said filter (19) and at least one said storage bag (17) are substantially aligned vertically to each other.

* * * * *